US005706838A

United States Patent [19]

St. James

[11] Patent Number: 5,706,838

[45] Date of Patent: Jan. 13, 1998

[54] HAIR-ROLLING FASHION ACCESSORY

[75] Inventor: Debra St. James, 61 Racket Cir., Rancho Cordova, Calif. 95742

[73] Assignee: Debra St. James, Rancho Cordova, Calif.

[21] Appl. No.: 639,722

[22] Filed: Apr. 29, 1996

[51] Int. Cl.[6] ..... A45D 8/36; A45D 2/02; A45D 2/18

[52] U.S. Cl. ..... 132/246; 132/273

[58] Field of Search ..... 132/246, 247, 132/273, 275

[56] References Cited

U.S. PATENT DOCUMENTS

| | | | |
|---|---|---|---|
| 347,177 | 8/1886 | Heysinger | 132/246 |
| 348,263 | 8/1886 | Blakesley | 132/246 |
| 1,406,586 | 2/1922 | Scheib | 132/246 |
| 2,061,817 | 11/1936 | Van Cleef | 132/246 |
| 2,542,601 | 2/1951 | Van Cleef | 132/246 |
| 2,693,809 | 11/1954 | Spencer | 132/246 |
| 4,577,647 | 3/1986 | Fenster et al. | 132/246 |
| 5,306,191 | 4/1994 | Dutch . | |

FOREIGN PATENT DOCUMENTS

| | | | |
|---|---|---|---|
| 175980 | 6/1953 | Austria | 132/236 |
| 2621790 | 4/1989 | France | 12/246 |
| 821813 | 10/1959 | United Kingdom | 132/246 |
| 2116032 | 9/1983 | United Kingdom | 132/246 |

OTHER PUBLICATIONS

"Soft 'n Easy" Hair Rollers, Goody Products, Inc., Kearny, NJ, 1991, 1 page brochure.

*Primary Examiner*—Todd E. Manahan

[57] ABSTRACT

A hair rolling fashion accessory comprises an elongated body formed of a high-density, high-compression foam rubber which has a bendable core element embedded therein. A protective fabric cover made of a cotton/poly blend of material entirely encloses the elongated body. The elongated body has a square cross-sectional area for improved grip in roll-ups and styling. The bendable core element is formed of a high-flex precoated wire and has a shorter length than the length of the elongated body such that the ends of the bendable core element are disposed a predetermined distance from the ends of the elongated body. The high-flex wire of the bendable core element has each end thereof bent back upon itself so as to prevent the high-flex wire from piercing the elongated body. The preferred embodiments of the invention consist of three different sizes: a small size having a length of approximately 7 inches and a height and a width of approximately ¾ inch; a medium size having a length of approximately 9 inches and a height and width of approximately 1 inch; and a large size having a length of approximately 9 inches and a height and width of approximately 1¼ inch.

4 Claims, 2 Drawing Sheets

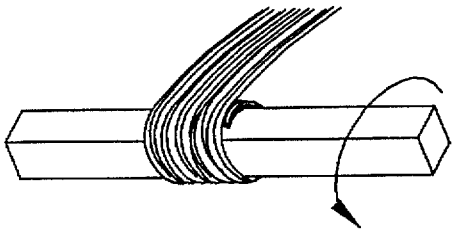
FIGURE 2A
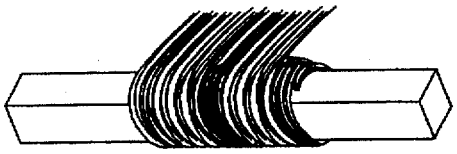
FIGURE 2B
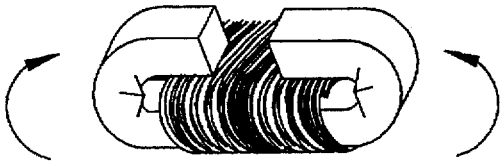
FIGURE 2C
FIGURE 3A
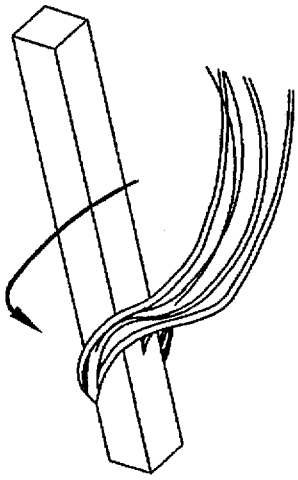
FIGURE 3B
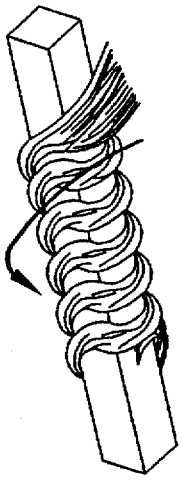
FIGURE 3C
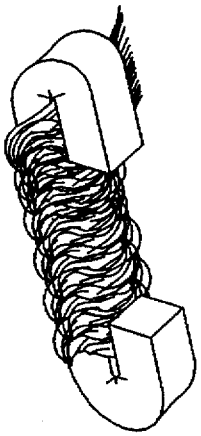

HAIR-ROLLING FASHION ACCESSORY

BACKGROUND: FIELD OF THE INVENTION

Invention relates in general to the method of hair rolling and hair fashion accessory that incorporates certain new improvements in design and materials, that does not damage hair, that is soft to sleep on, that is small, durable, lightweight, portable and self-locking, that requires no electricity or loose parts and which offers the most versatility for maximum available hair styles and is also a hair styling accessory from formal to beach wear.

BACKGROUND: DESCRIPTION OF PRIOR ART

Traditional hair rollers are comprised of either sponge with clips or fasteners, wire mesh with clips or fasteners, and wire, wrapped with foam and covered by cloth covering. U.S. Pat. No. 5,272,152 of Dec. 13, 1994

The most similar type of prior art to the within offered product, consist of similar usage of Foam, Fabric & Wire however, the design creates roller gaps and offers only one traditional roll-up method; limiting versatility of usage. The synthetic fabric cover makes the roll-up process difficult as the hair slips, slides, and doesn't hold well to the surface of the roller. The wire (gauge unknown) is exposed; allowing potential piercing of the fabric covering which can be uncomfortable to sleep on and possibly stab into the head. The foam (grade unknown) surrounding the wire covers only two inches of wire surface; resulting in very limited surface area for usage abilities; it can NOT be utilized as a hair styling accessory. U.S. Pat. No. 4,540,006 of 1981.

A similar prior art consists of Registered trademark SOFT & EASY HAIR ROLLERS sold by Goody Co. provides a wire covered by hard, thin foam and plastic beads at each end. There is no cloth covering. This product fails usage test in that the plastic beads are easily removed; revealing dangerous exposed wire ends.

The lack of cloth covering and the stiffness of the foam covering, result in excess slippage of hair and the foam and wire are too rigid to be comfortable or effective as a hair roller. The inflexible hard, thin foam covering and rigid design makes it ineffective an inappropriate as a hair accessory.

The present invention, created by a Model in need of a hair rolling product that did not damage hair, that was soft to sleep on, that was small, durable, lightweight, portable and self-locking, that required no electricity or loose parts and which offered the most versatility for maximum available hair styles and was also a hair styling accessory from formal to beach wear. The present invention provides superior design versatility and maximum possible roll-up options over any other prior art.

This unique design is the only one which is both a hair-roller and a hair styling fashion accessory.

OBJECTS OF THE INVENTION

It is the object of the present invention to provide a durable, low cost, easy to use, alternative to traditional curling devices, utilizing 6" to 9" lengths of high-flex coated wire covered by high-density, high-compression foam which is square-cut for grip/hold, surrounded by a protective cotton/poly fabric sleeve to provide maximum hair style possibilities as well as multiple hair fashion accessory possibilities.

It is another object of the present invention to provide a product that does not cause hair damage, that is self-locking and that is totally versatile for every day use; providing a multitude of curling styles, as well as maintaining the unique ability to be utilized within a hairstyle and worn in public as a hair fashion accessory.

A further object of the present invention is to provide three (3) distinct small, medium, and large sizes utilizing the entire length of the roller for maximum usable surface area per roller.

Another object for the present invention if to offer both Horizontal and Vertical curling/styling abilities.

It is a further object of the present invention to incorporate high grade, high-flex coated wire, high-density, high-compression foam and a cotton blend materials to provide durable, safe, and comfortable usage even when sleeping.

Another object of the present invention is to avoid damage to hair follicles, that avoids snapping, stretching, or breaking hair in the roll-up or removal of the hair from the roller by using the unique combination of materials to provide maximum surface area for hair rolling as well as versatility of style options for both hair roll-ups and hair fashion accessory.

It is another object of the present invention to provide a variety of colors for the cotton blend fabric sleeve for maximum fashion coordination abilities.

BRIEF DESCRIPTION OF THE DRAWINGS

FIGS. 2A–2C depict a method of utilizing the device of the instant invention for Horizontal roll-up styles.

FIGS. 3A–3C depict a method of utilizing the device of the instant invention for Vertical roll-up styles.

DETAILED DESCRIPTION OF THE PREFERRED EMBODIMENT

Figure 1A:
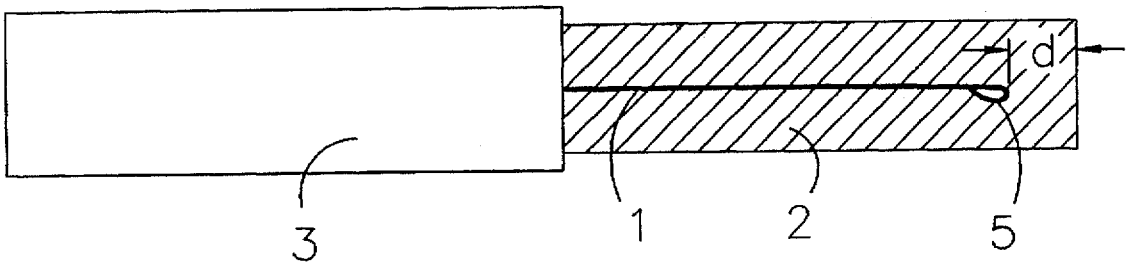
FIG. 1A is a plan view showing the various elements of the preferred embodiment of the invention.
Figure 1B:
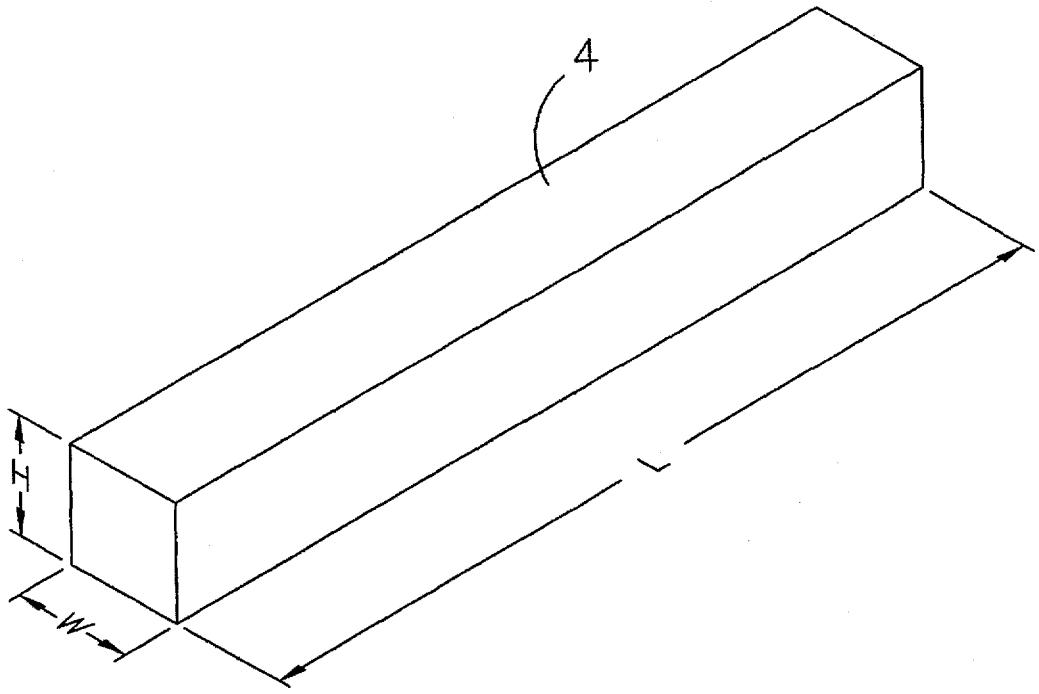
FIG. 1B is an isometric view of the preferred embodiment of the invention.

Referring to the accompanying figures where like numerals refer to like parts on all figures, there is shown a FIG. 1A a plan view of the various elements which make up the hair fashion accessory 4 of the instant invention. The hair fashion accessory comprises an elongate body 2 formed of a high-density, high-compression foam rubber, a bendable core element 1 formed of a high-flex precoated wire which is embedded within the elongate body 2, and a protective fabric cover 3 which entirely encloses the elongate body 2. The high-flex wire has each end thereof bent back upon itself such that the ends 5 of the bendable core element do not pierce or puncture the elongate body. The bendable core element 1 has a length shorter than the length of the elongate body such that each end 5 thereof terminates a distance d from the end of the elongate body. In the preferred embodiments, the elongate body is ½ to ¾ inch longer than the length of the high-flex wire of the bendable core element 1 and the protective fabric cover is ⅛ to ¼ inch larger on all sides than the elongate body.

As can be seen in 1B, a hair fashion accessory 4 of the instant invention is square in cross-section and has a height H, and width W and length L. Although it may have various dimensions, the hair fashion accessory of the present invention is made in three preferred sizes: a small size having a length L of approximately 7 inches, and a height H and width W of approximately ¾ inch, and a distance d of approximately 1 inch; a medium size having length L of approximately 9 inches, and a height H and width W of approximately 1 inch, and a distance d of approximately 1 inch; and a large size having a length L of approximately 9 inches, and a height H and width W of approximately 1¼ inch, and a distance d of approximately 1 inch.

The high-flex wire is a durable, flexible, coated wire material which provides for maximum styling surface area, styling possibilities, and longevity of use. The high-density, high-compression foam provides a durable, soft, comfortable and flexible surface with minimum deterioration of the original shape. The square cross-section provides for better grip/hold for roll-ups and styling. The cotton/poly blend fabric cover makes the device durable, long-lasting, non-allergenic and readily washable for hygienic purposes. The cotton/poly blend fabric cover also provides the device with a non-slip outer surface.

The device can be used to create various hair styles, such as French Twists, Formal and Casual Buns, Pony Tails, Pig-Tails etc. . . . New styles are being created daily with this device.

FIG. 2A–2C show on method of using the device for Horizontal roll-up styles. In this method, the user takes the hair rolling fashion accessory, holding it horizontal to the floor, and evenly winds the hair around the device in an under and over, or over and under, manner as shown in FIG. 2A. The user continues rolling the hair evenly about the device rolling horizontally toward the scalp, as shown in FIG. 2B. At the scalp, the roll-up is locked-in by firmly bending each end back upon itself, as shown in FIG. 2C.

FIGS. 3A–3C show a method of using the device for Vertical roll-up styles. In this method, the user takes the hair rolling fashion accessory, holding it vertically to the floor, and winds the hair evenly around the bottom end of the device, as shown in FIG. 3A. The user continues to wind hair evenly up the device toward the scalp, in the manner as shown in FIG. 3B. As the scalp, each end of the device is bent firmly back upon itself to lock-in the roll-up, as shown in FIG. 3C.

The foregoing will have clearly elaborated the detailed description of the illustrated preferred and alternative embodiments of the present instant invention.

I claim:

1. A hair rolling fashion accessory comprising:

an elongated body formed of a high-density, high-compression foam rubber, said elongated body having a square cross-sectional area and a predetermined length;

a bendable core element formed of a high-flex precoated wire embedded in said elongated body, said high-flex wire having two ends; and a protective fabric cover entirely enclosing said elongated body, wherein said bendable core element has a length shorter than the length of said elongated body and is disposed within said elongated body such that the ends of said high-flex wire of said bendable core element are disposed within said elongated body a predetermined distance from the ends thereof.

2. A hair rolling fashion accessory as set forth in claim 1 wherein said high-flex wire of said bendable core element has each end thereof bent back upon itself so as to prevent said high-flex wire from piercing said elongate body.

3. A hair rolling fashion accessory as set forth in claim 1 wherein said protective fabric cover is made of a cotton/poly blend for preventing damage to the hair and for preventing fading and shrinkage of the fabric cover from repeated usage.

4. A hair rolling fashion accessory as set forth in claim 1 wherein said elongate body has a length of approximately 6 to 9 inches and a cross-sectional area of approximately 9/16 to 1 9/16 square inches.

* * * * *